US009174226B2

(12) United States Patent
Su et al.

(10) Patent No.: US 9,174,226 B2
(45) Date of Patent: Nov. 3, 2015

(54) WATER SPRAY GUN

(71) Applicant: Ningbo Daye Garden Industrial Co., Ltd., Yuyao (CN)

(72) Inventors: Ke Su, Yuyao (CN); Xiaodong Ye, Yuyao (CN); Yao Zhang, Yuyao (CN); Bolin Tang, Yuyao (CN); Zhenming Zhou, Yuyao (CN)

(73) Assignee: NINGBO DAYE GARDEN SCIENCE COMPANY, Yuyao (CN)

( * ) Notice: Subject to any disclaimer, the term of this patent is extended or adjusted under 35 U.S.C. 154(b) by 38 days.

(21) Appl. No.: 14/231,687

(22) Filed: Mar. 31, 2014

(65) Prior Publication Data

US 2014/0306032 A1 Oct. 16, 2014

(30) Foreign Application Priority Data

Apr. 16, 2013 (CN) ..... 2013 1 0140552

(51) Int. Cl.

| | |
|---|---|
| ***B05B 1/16*** | (2006.01) |
| ***B05B 9/01*** | (2006.01) |
| ***B05B 12/00*** | (2006.01) |
| ***B05B 1/30*** | (2006.01) |

(52) U.S. Cl.

CPC ..... *B05B 1/1645* (2013.01); *B05B 1/169* (2013.01); *B05B 1/1654* (2013.01); *B05B 1/3026* (2013.01); *B05B 12/002* (2013.01); *B05B 9/01* (2013.01)

(58) Field of Classification Search

CPC .... B05B 1/1645; B05B 1/1654; B05B 1/169; B05B 9/01; B05B 12/002

See application file for complete search history.

(56) References Cited

U.S. PATENT DOCUMENTS

| | | | | |
|---|---|---|---|---|
| 6,612,507 | B1 * | 9/2003 | Meyer et al. | 239/394 |
| 7,240,858 | B2 * | 7/2007 | Wang | 239/526 |
| 7,370,814 | B2 * | 5/2008 | Chih | 239/394 |
| 2005/0274826 | A1 * | 12/2005 | Chen | 239/526 |

* cited by examiner

*Primary Examiner* — Ryan Reis

(74) *Attorney, Agent, or Firm* — Matthias Scholl P.C.; Matthias Scholl

(57) ABSTRACT

A water spray gun, including: a gun body, a valve switch, and a device for switching a spray pattern. The gun body includes: a water passage and double water hole. The valve switch includes: a button, a pressing piece including a unilaterally oblique plane, a rear plate including an inner guide rail, a rotating piece including a unilaterally oblique plane, a first spring, a front sealing ring, a switch rotating core, and a double sealing ring. The device for switching a spray pattern includes a water spray cap, a water spray plate, a decentered interface, a second spring, a wedge rotating piece for water diversion including a plurality of negative wedge blocks each including a negative wedge, a wedge push rod including a plurality of positive wedge blocks each including a positive wedge, a housing of a gun head, and a trigger.

9 Claims, 25 Drawing Sheets

WATER SPRAY GUN

CROSS-REFERENCE TO RELATED APPLICATIONS

Pursuant to 35 U.S.C. §119 and the Paris Convention Treaty, this application claims the benefit of Chinese Patent Application No. 201310140552.8 filed Apr. 16, 2013, the contents of which are incorporated herein by reference. Inquiries from the public to applicants or assignees concerning this document or the related applications should be directed to: Matthias Scholl P. C., Attn.: Dr. Matthias Scholl Esq., 14781 Memorial Drive, Suite 1319, Houston, Tex. 77079.

BACKGROUND OF THE INVENTION

1. Field of the Invention

The invention relates to a water spray gun.

2. Description of the Related Art

A typical water spray gun generally includes: a handle, and an elastic top plug. Working principle of the water spray gun is as follows: the water is sprayed out when pressing the handle, and the top plug is reset and sealed under the force of the spring. Such a water spray gun brings in inconvenience in use. The user must continuously press the handle of the water spray gun to allow a continuous water jet to be sprayed out, which easily makes the user feel tired after long-term use. Consequently, a lock button having a triangular ring and a rotating shaft is disposed on the water spray gun for tackling the above problem. However, the water spray gun must operated by two hands. In other words, when the handle of the water spray gun is held by the right hand, the user must use fingers and nails of the left hand to release the lock button and make the lock button rotate for a relatively large angle (e.g. 45°) and be stably fixed in an inner part of an upper edge of the handle. To stop the water spray gun, the user must use the right hand to hold the handle of the water spray gun to allow the lock button to be released, and then use fingers and nails of the left hand to release the lock button and make the lock button rotate for a relatively large angle (e.g. 45°) again and be stably fixed in the upper edge of the handle. Thus, the double-handed operation of such water spray gun is troublesome, and it is desired to develop a new type of water spray gun with one-handed operation.

SUMMARY OF THE INVENTION

In view of the above-described problems, it is one objective of the invention to provide a water spray gun that is operable by one hand and is able to switch the water spray pattern.

A water spray gun comprises: a gun body, the gun body comprising: a water passage and double water hole disposed therein; a valve switch, the valve switch comprising: a button, a pressing piece comprising a unilaterally oblique plane, a rear plate comprising an inner guide rail, a rotating piece comprising a unilaterally oblique plane, a first spring, a front sealing ring, a switch rotating core, and a double sealing ring being successively mounted at an upper rear part of the gun body; and a device for switching a spray pattern, the device comprising a water spray cap, a water spray plate, a decentered interface, a second spring, a wedge rotating piece for water diversion comprising a plurality of negative wedge blocks each comprising a negative wedge, a wedge push rod comprising a plurality of positive wedge blocks each comprising a positive wedge, a housing of a gun head, and a trigger being successively mounted on an upper part of the gun body. The button is movably disposed on an upper rear part of the gun body for controlling the valve switch to close or open the water passage. The trigger is movably disposed at a middle part of the gun body for controlling the device for switching the spray pattern via a pin. A water flowing state and a water stopping sate of the switch valve are switched by pressing and releasing the button for once. When the button is pressed, the pressing piece is driven by the inner guide rail of the rear plate to move merely in a pressing direction while the rotating piece is driven by the unilaterally oblique plane of the pressing piece to rotate. The switch rotating core is driven by the rotating piece to close or open the double water hole disposed inside the gun body to control the water flow in the water passage whereby realizing the switch between the water flowing state and the water stopping state. When a lower part of the trigger is pressed, an upper part of the trigger functions as a lever using the pin as a fulcrum and pushes the wedge push rod. The positive wedge of each positive wedge block disposed on the wedge push rod interacts with the negative wedge of each negative wedge block disposed at the wedge rotating piece for water diversion so as to drive the wedge rotating piece for water diversion to rotate. The water spray cap is driven by the wedge rotating piece for water diversion to rotate thereby realizing the switch of the water diversion. An integral structure of the water spray gun employs the button to allow the water to pass through, employs the trigger switch the spray pattern, so that the water spray gun can be totally operated by one hand.

The positive wedge blocks are uniformly arranged on a periphery of a circular disc of a main body of the wedge push rod along an axis thereof. Each positive wedge block is provided with an oblique plane to form the positive wedge. The positive wedge is capable of cooperating with the negative wedge of each of the negative wedge blocks of the wedge rotating piece for water diversion to drive the wedge rotating piece for water diversion to rotate thereby switching the spray pattern.

The positive wedge blocks are uniformly arranged on a periphery of a circular disc of a main body of the wedge push rod along an axis thereof. Each positive wedge block is provided with an oblique plane being an equiangular spiral surface featuring in equivalent pressure angles or a logarithmic spiral surface. The positive wedge is capable of cooperating with the negative wedge of each of the negative wedge blocks of the wedge rotating piece for water diversion to drive the wedge rotating piece for water diversion to rotate thereby switching the spray pattern.

Two push rods are symmetrically extended from a circular disc of a main body of the wedge push rod along an axis thereof. On each push rod is disposed a recess, and two sides of the recess are in the shape of an arc for allowing the trigger to pluck thereof.

A pin through hole is disposed at a middle part of the trigger for allowing the pin to pass through and be movably mounted on the gun body. An upper part of the trigger is provided with a double-prong fork. The wedge push rod is provided with two push rods, each push rod comprises a recess having two sides in the shape of an arc. The double-prong fork is capable of plucking the recesses of the push rods on the wedge push rod.

The rear plate is provided with the inner guide rail formed by a plurality of uniformly arranged splines for allowing lateral sides of positive wedge planes of the pressing piece to move merely in the pressing direction.

A plurality of positive wedge planes are uniformly arranged on a column of a main body of the pressing piece along an axis thereof for pushing the unilaterally oblique plane of the rotating piece to allow the rotating piece to rotate. A cross convex arranged on the rotating piece matches with a cross concave arranged on the switch rotating core for driving the switch rotating core to rotate thereby turning on or off the water flow.

A plurality of positive wedge planes are uniformly arranged on a column of a main body of the pressing piece along an axis thereof. Each of the positive wedge planes is an equiangular spiral surface featuring in equivalent pressure angles or a logarithmic spiral surface. The positive wedge plane of the pressing piece is capable of stably pushing the unilaterally oblique plane of the rotating piece to allow the rotating piece to rotate. A cross convex arranged on the rotating piece matches with a cross concave arranged on the switch rotating core for driving the switch rotating core to rotate thereby turning on or off the water flow.

A cross concave disposed at a middle part of the switch rotating core matches with a cross convex disposed at a middle part of the rotating piece for driving the switch rotating core to rotate thereby turning on or off the water flow. Water through holes provided with fan-shaped grooves are symmetrically arranged on two lateral sides of the center of the switch rotating core for allowing the water to pass through.

Advantages of the invention are summarized as follows:

The water spray gun of the invention is operable by one hand and is applied in garden and gardening. The design of the trigger of the water spray gun realizes the switch of the water spray pattern, and the button realizes turning on/off the water flow. Thus, the invention overcomes the difficulties in the conventional water spray guns, for example, the double-handed operation and inconvenience in switching the water spray pattern in the water flowing sate. Besides, the product of the invention decreases the possibility of misoperation by the user. The oblique plane of the positive wedge block is the equiangular spiral surface featuring in equivalent pressure angles or the logarithmic spiral surface, so that the positive wedge is capable of stably cooperating with the negative wedge. The water spray gun of the invention can be operated by one hand, thereby being convenient. The performance and working condition of the water spray gun are improved.

Figure 1:
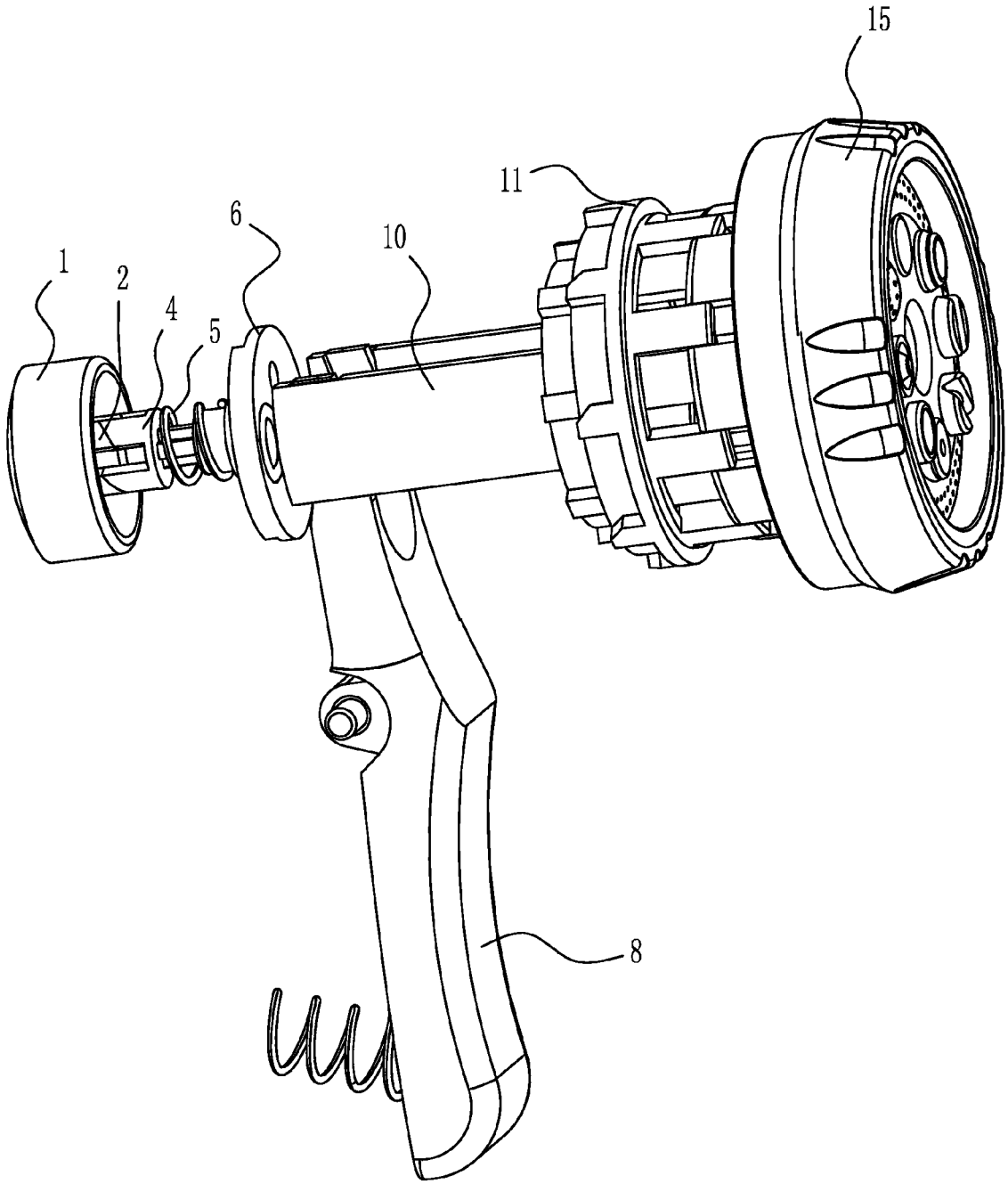
FIG. 1 is a first stereogram of an inner part of a water spray gun in the absence of a housing thereof.
Figure 2:
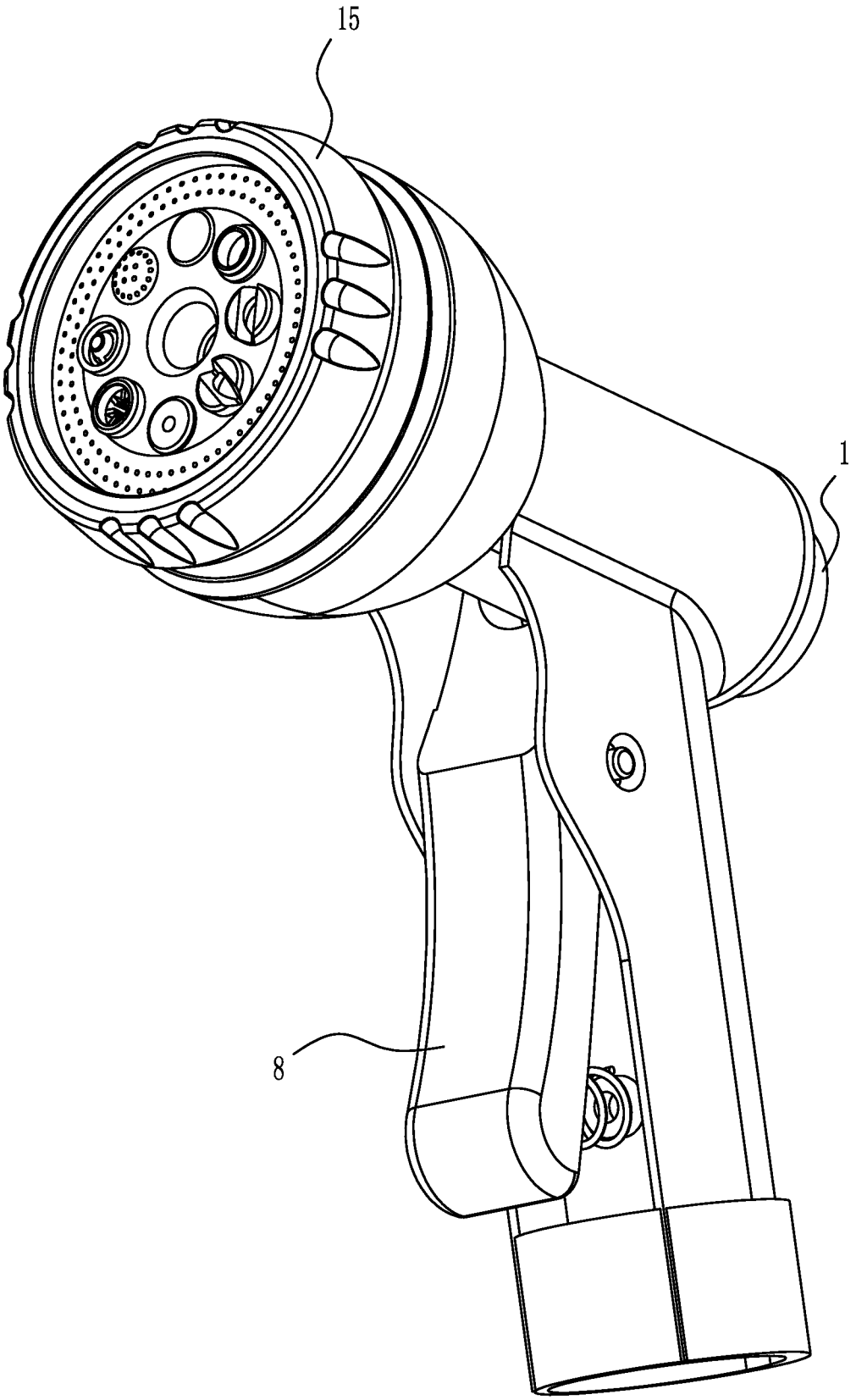
FIG. 2 is a stereogram of an outer part of a water spray gun.
Figure 3:
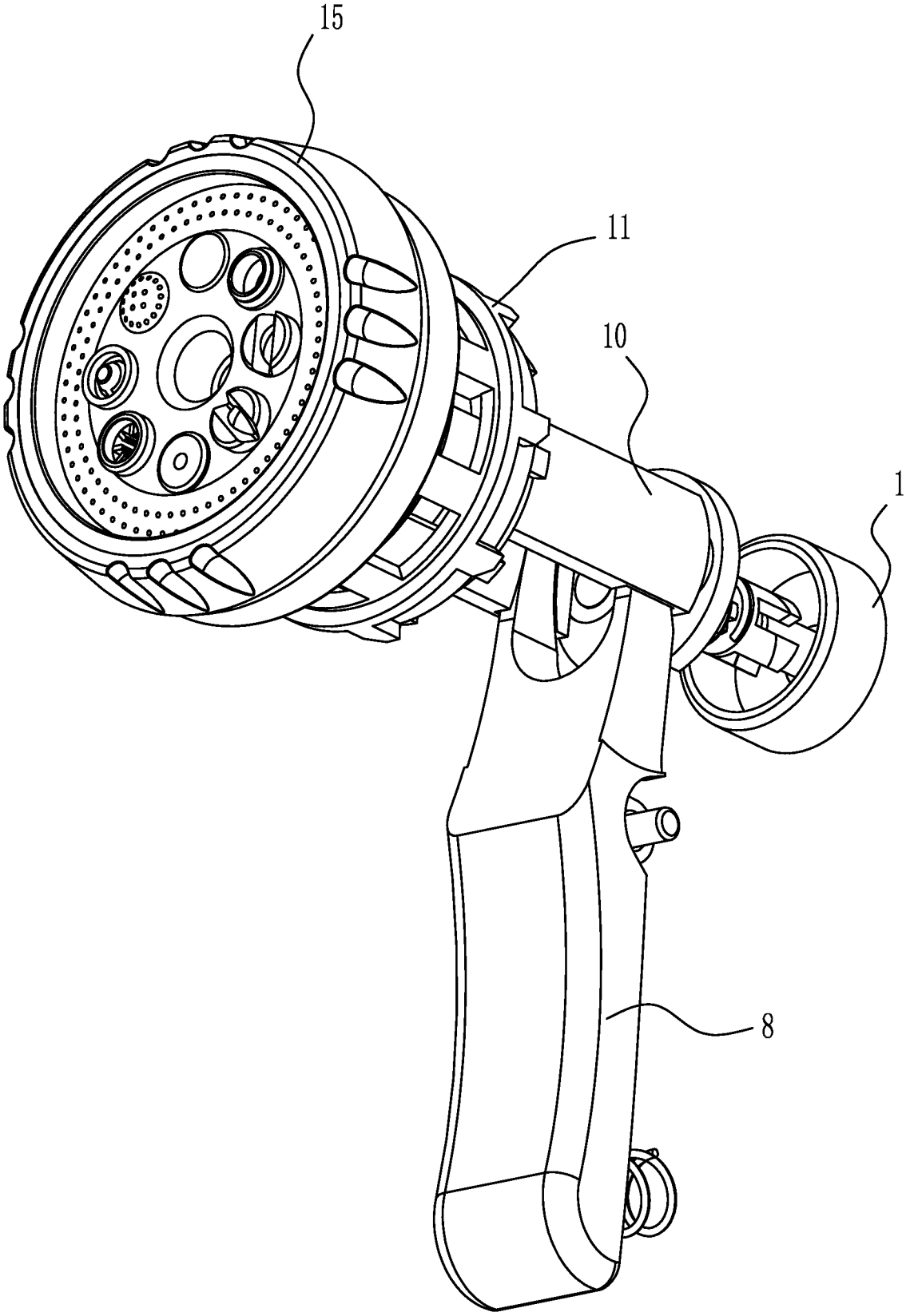
FIG. 3 is a second stereogram of an inner part of a water spray gun in the absence of a housing thereof.
Figure 4:
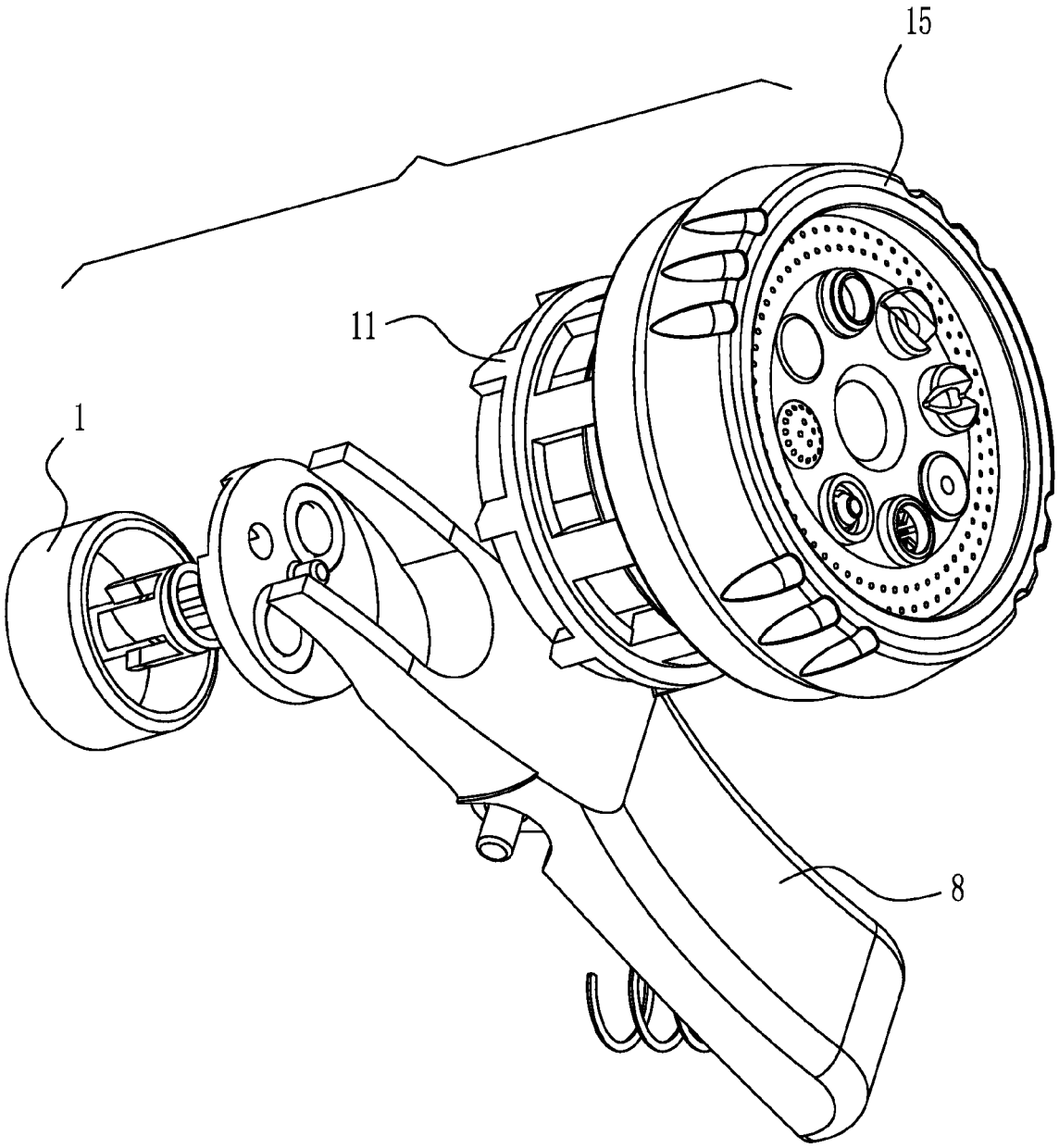
FIG. 4 is a third stereogram of an inner part of a water spray gun in the absence of a housing thereof.
Figure 5:
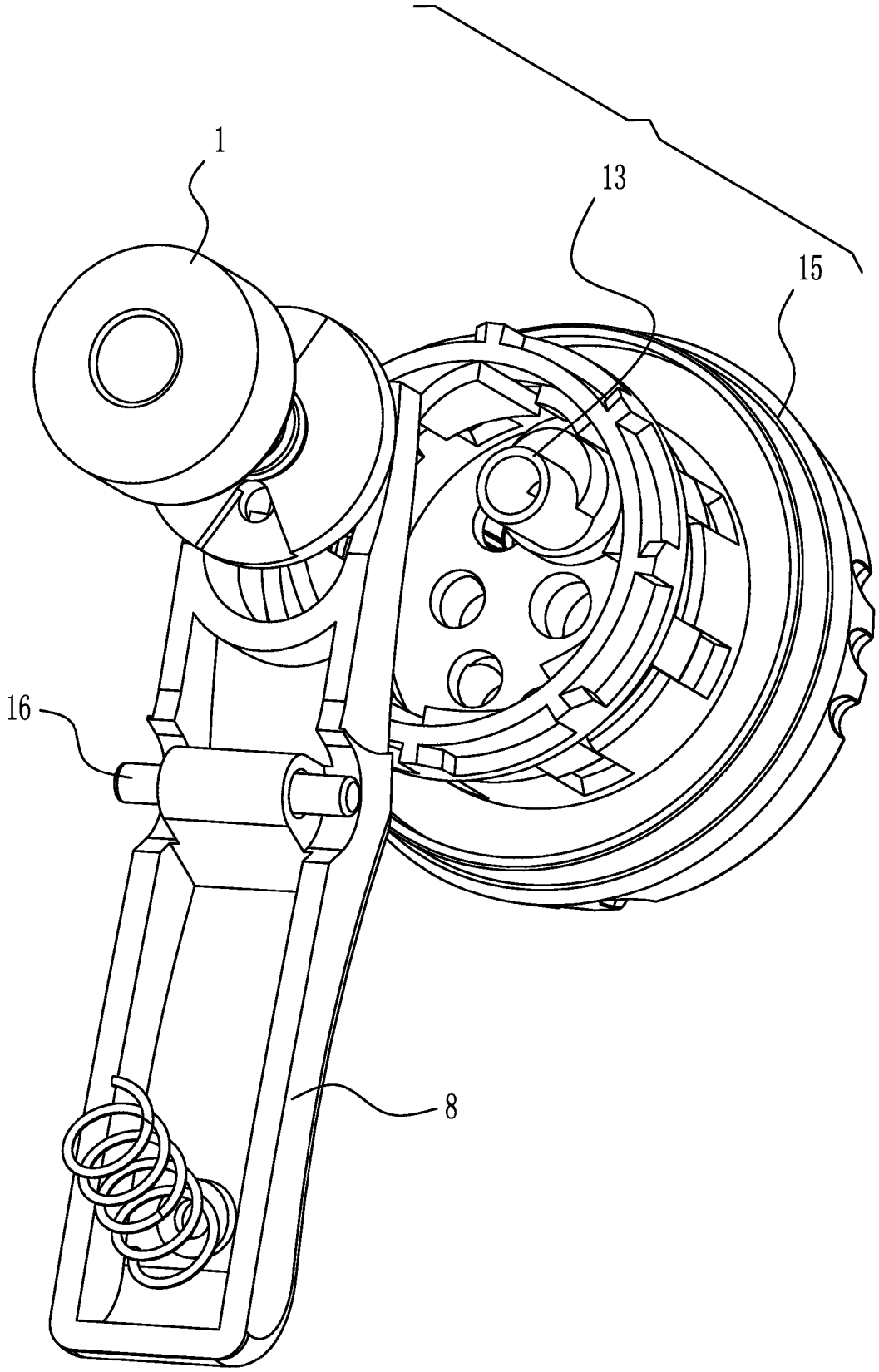
FIG. 5 is a fourth stereogram of an inner part of a water spray gun in the absence of a housing thereof.
Figure 6:
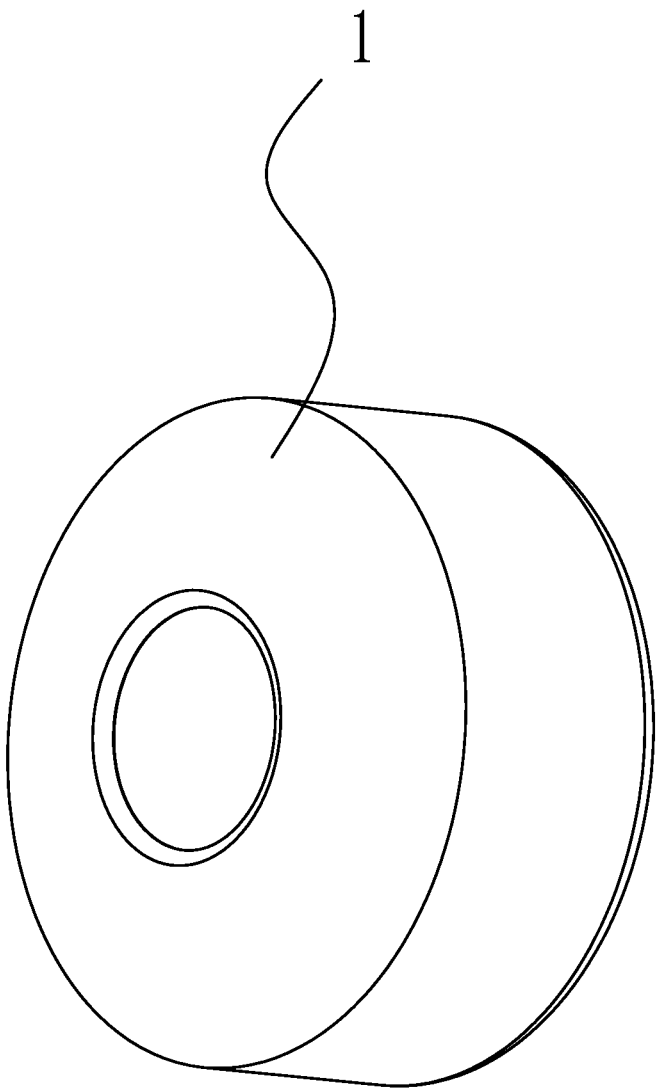
FIG. 6 is a stereogram of a button of a water spray gun.
Figure 7:
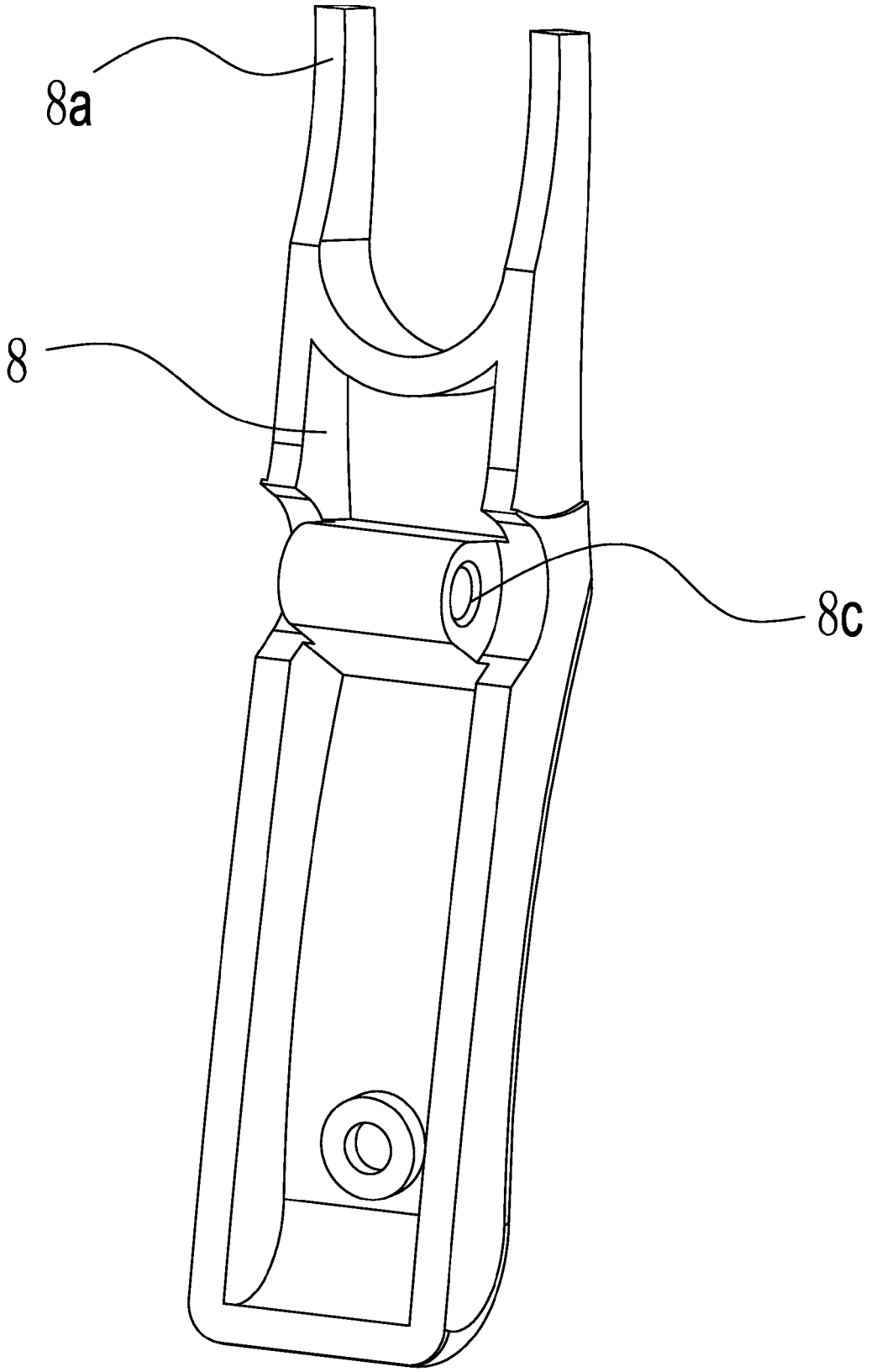
FIG. 7 is a first stereogram of a trigger of a water spray gun.
Figure 8:
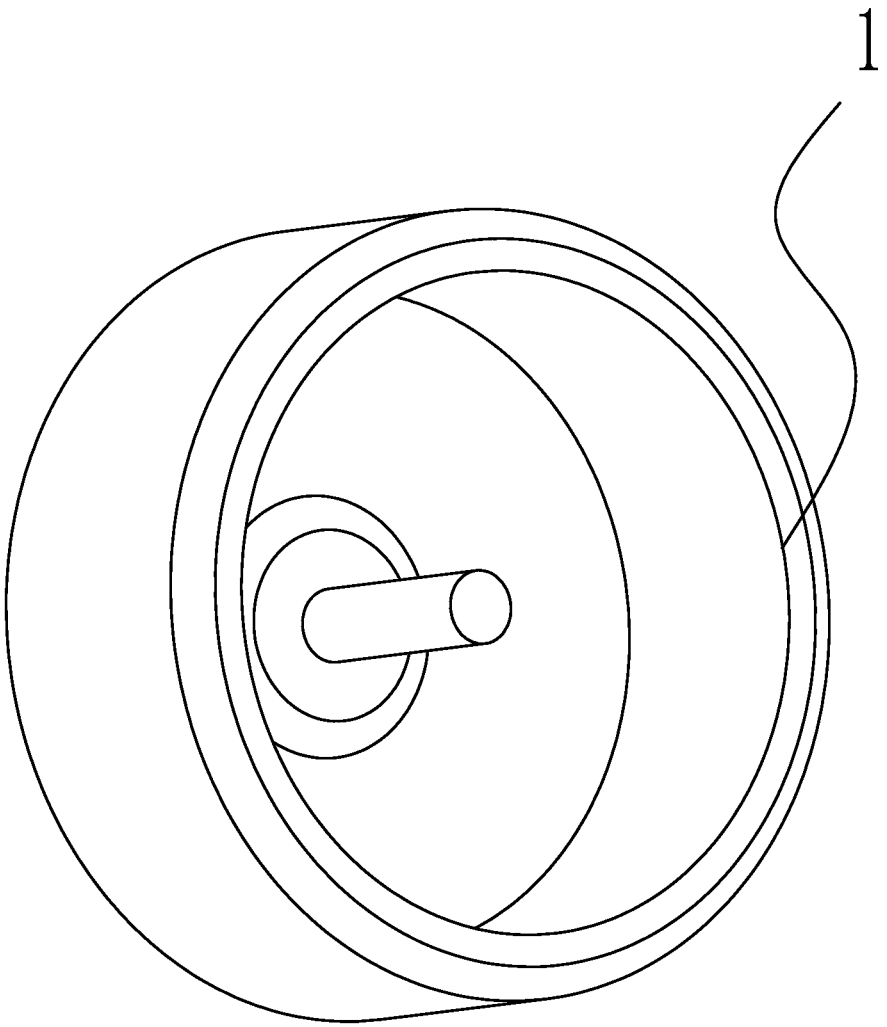
FIG. 8 is a stereogram of an inner part of a button of a water spray gun.
Figure 9:
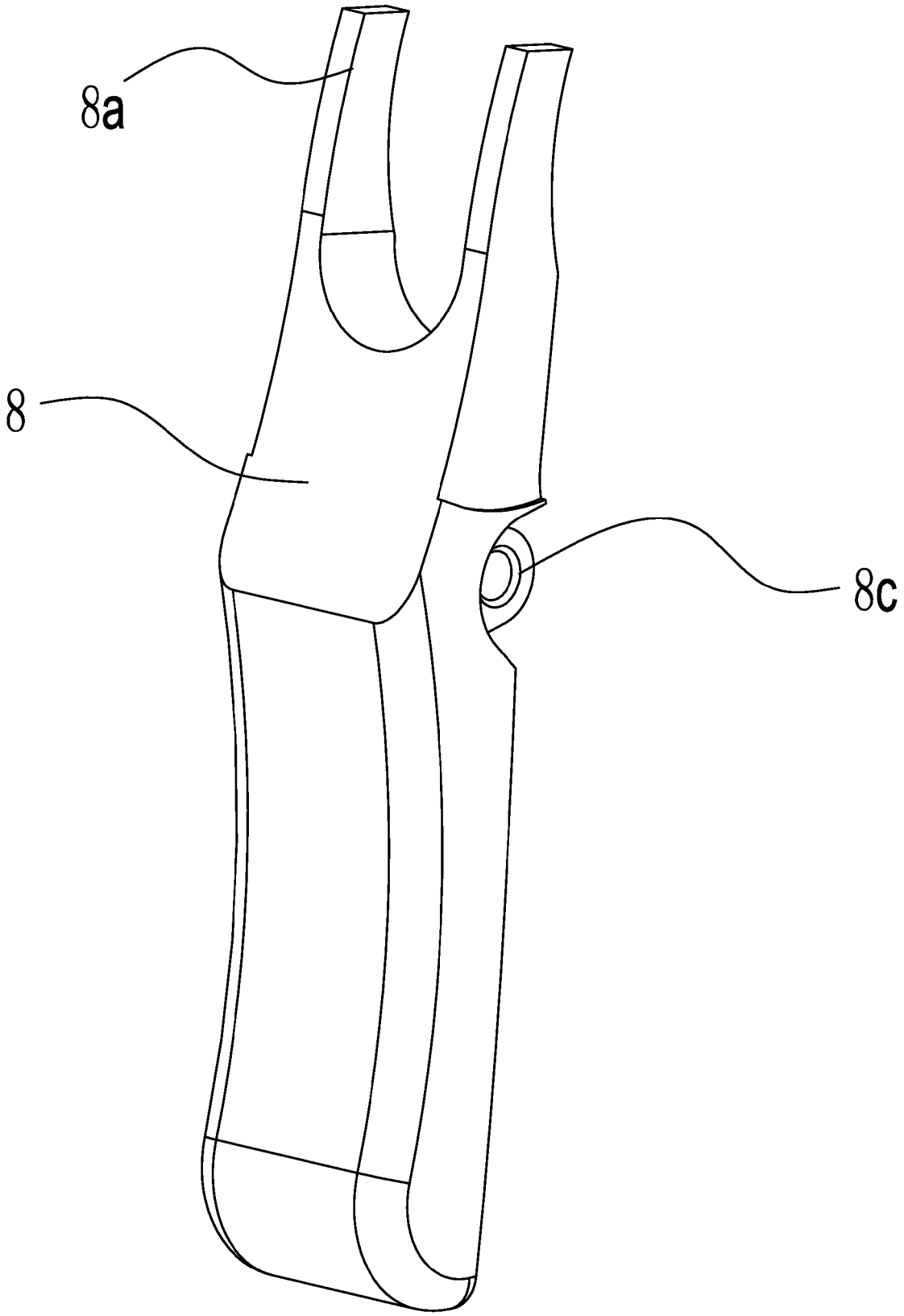
FIG. 9 is a second stereogram of a trigger of a water spray gun.
Figure 10:
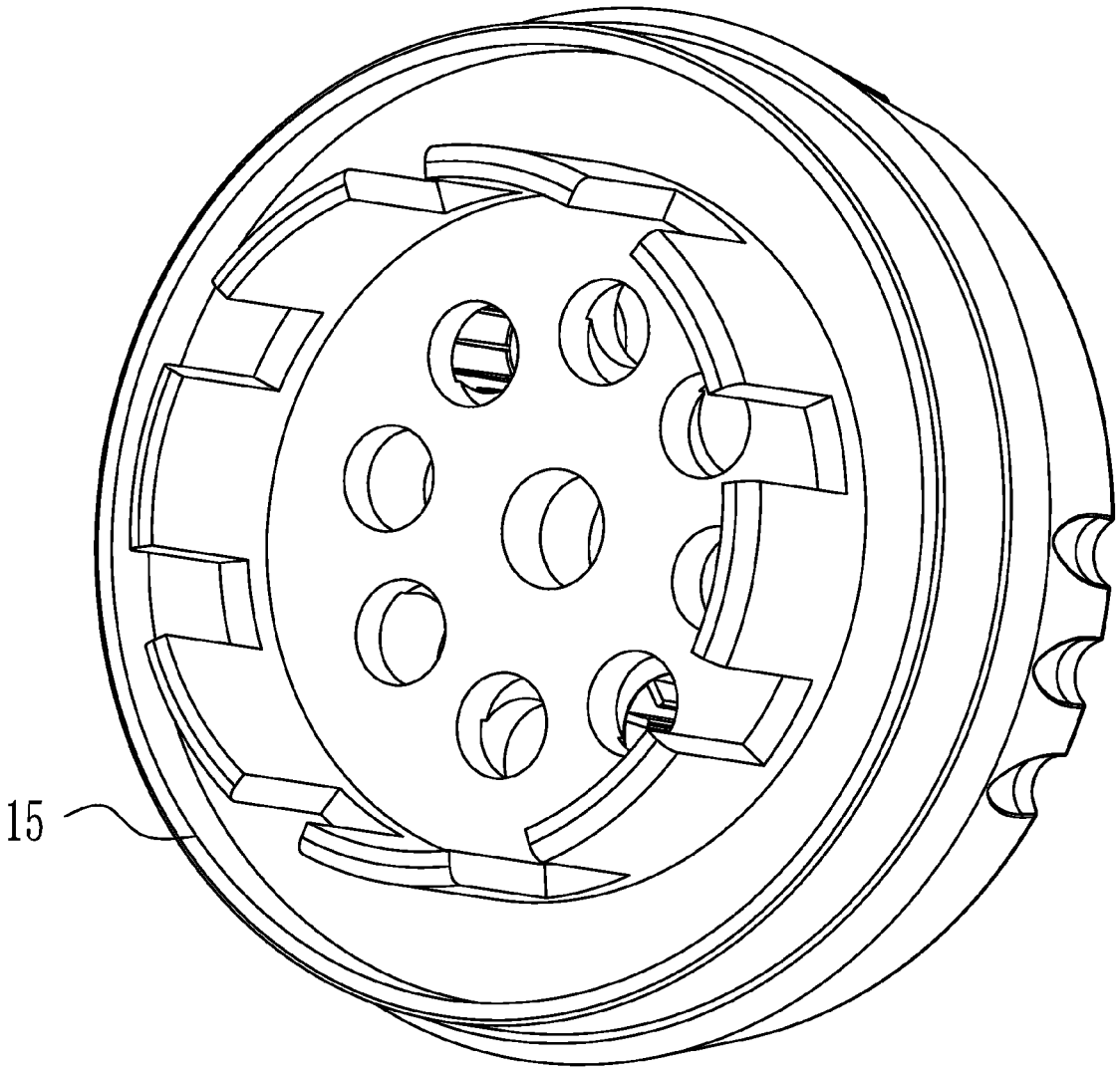
FIG. 10 is a stereogram of a water spray cap of a water spray gun.
Figure 11:
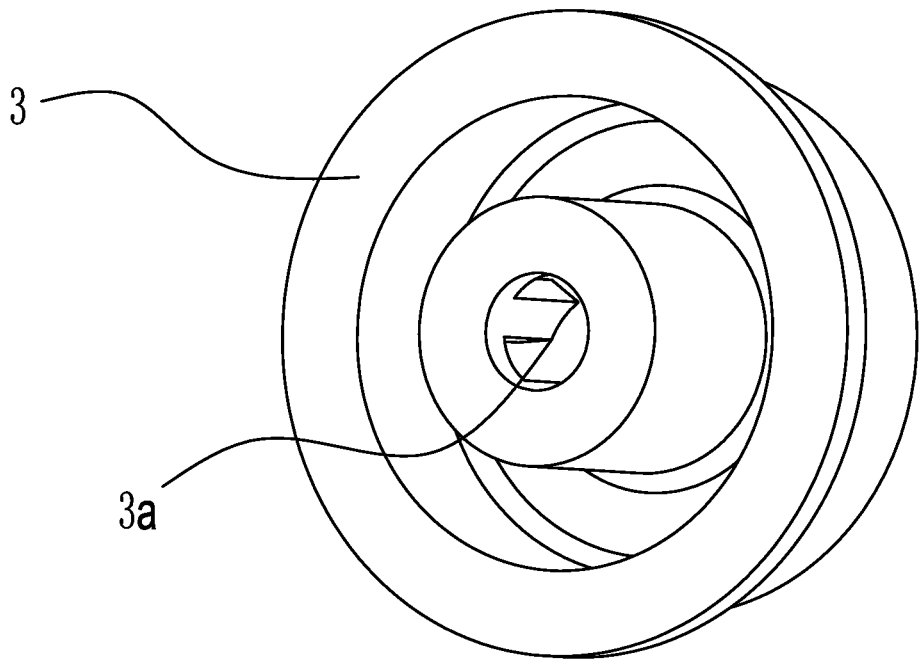
FIG. 11 is a stereogram of a rear plate comprising an inner guide grail of a water spray gun.
Figure 12:
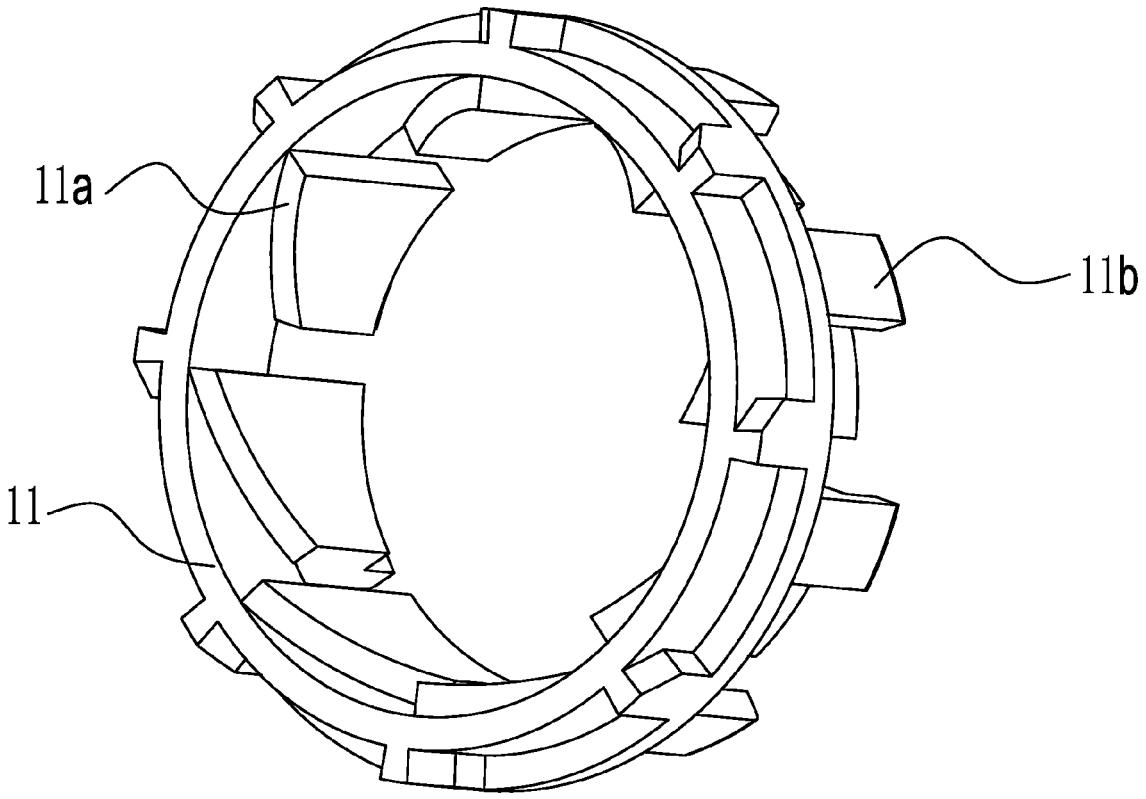
FIG. 12 is a first stereogram of a wedge rotating piece for water diversion of a water spray gun.
Figure 13:
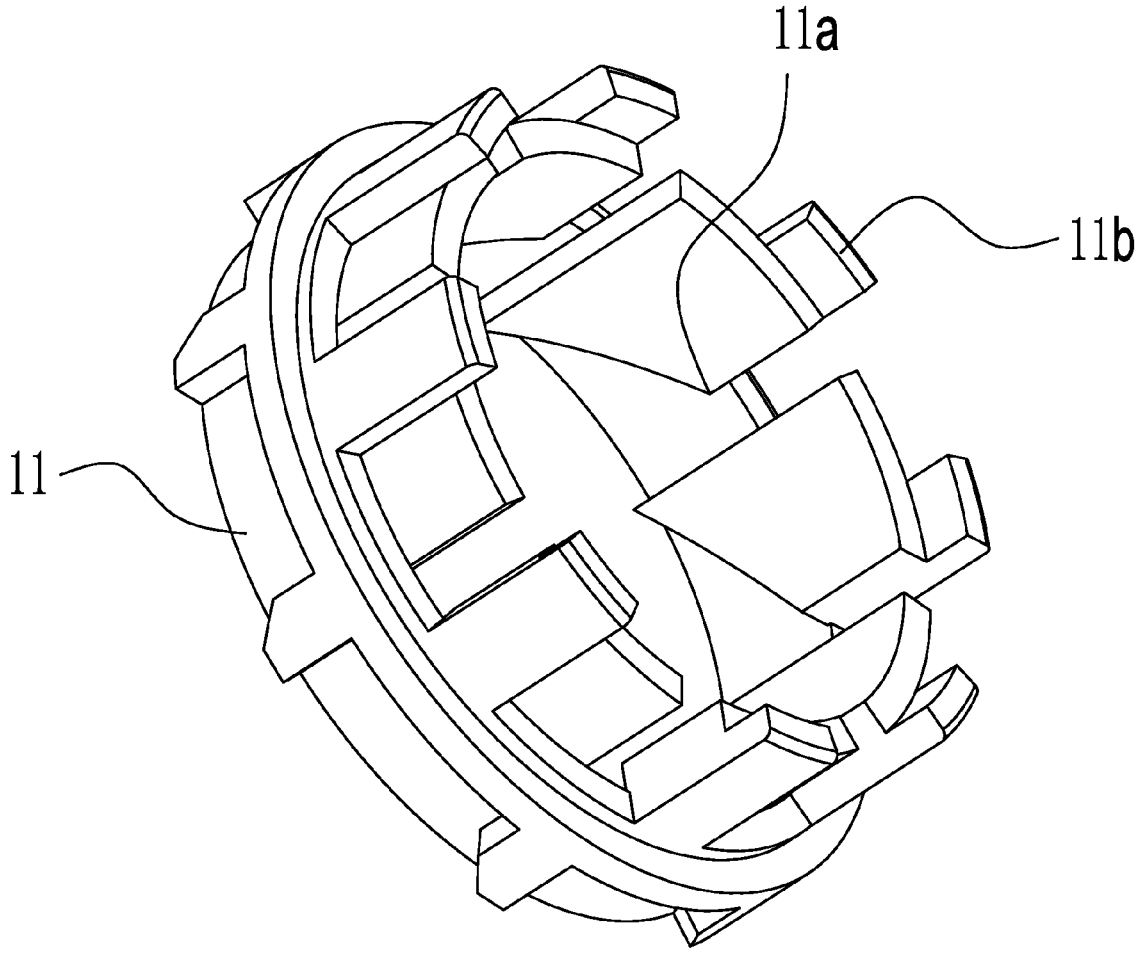
FIG. 13 is a second stereogram of a wedge rotating piece for water diversion of a water spray gun.
Figure 14:
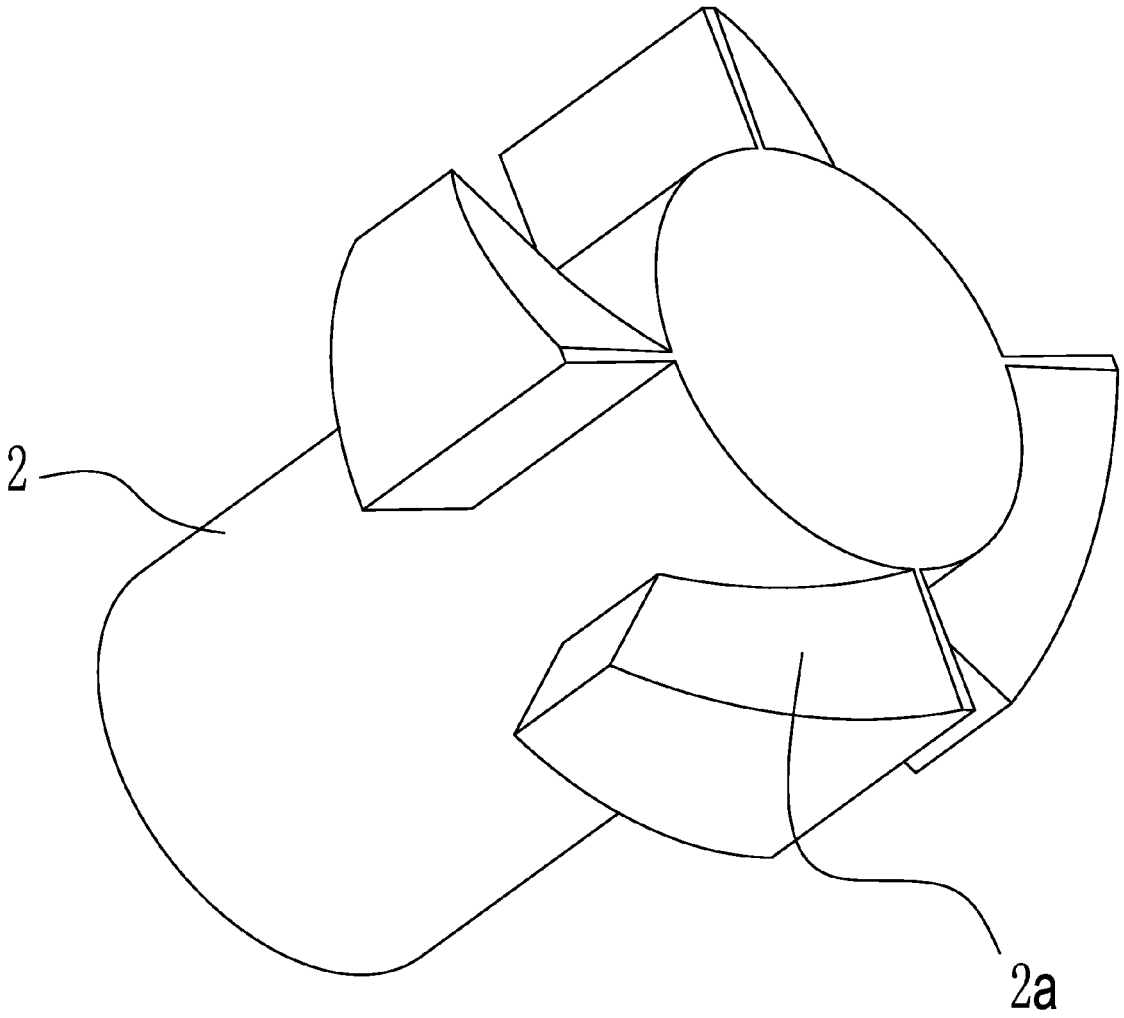
FIG. 14 is a first stereogram of a pressing piece comprising a unilaterally oblique plane of a water spray gun.
Figure 15:
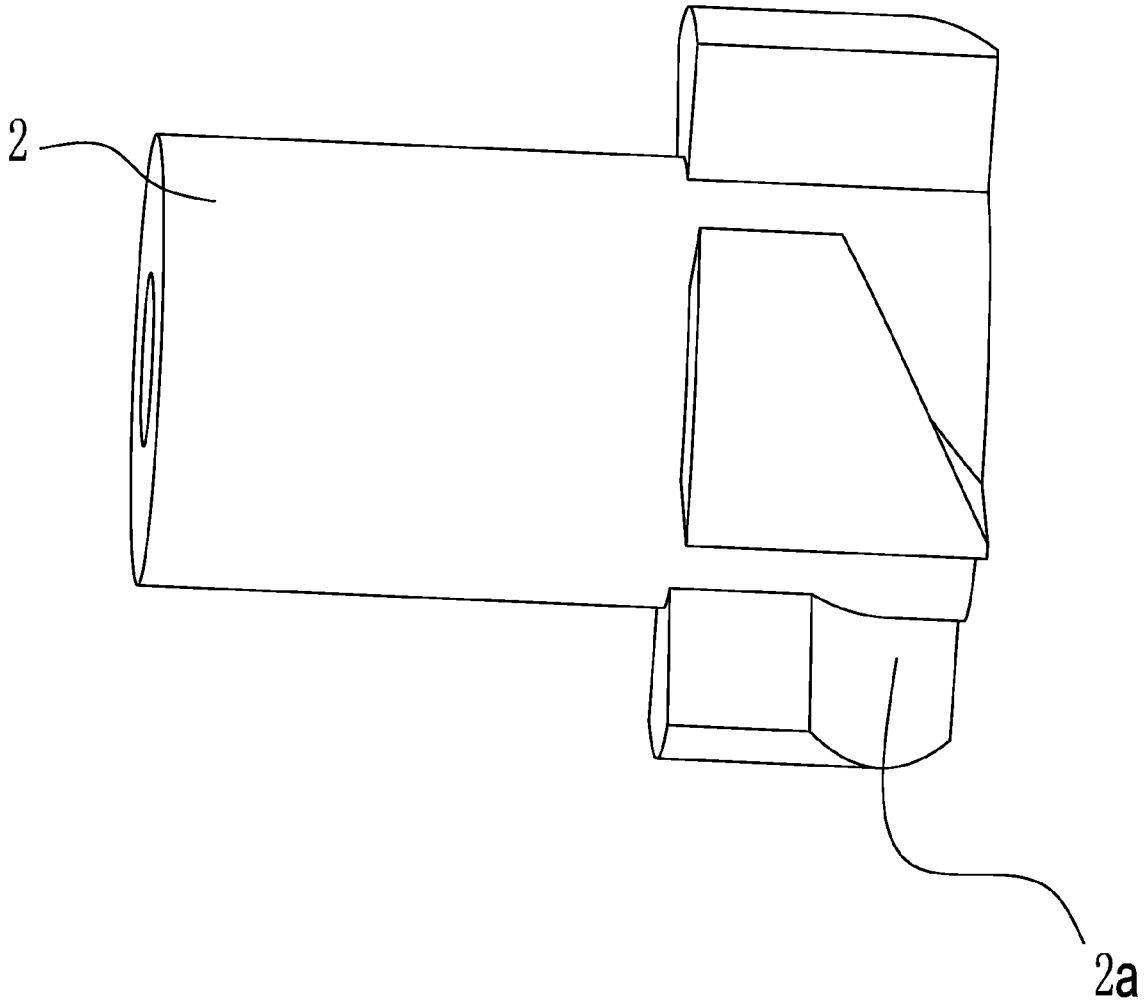
FIG. 15 is a second stereogram of a pressing piece comprising a unilaterally oblique plane of a water spray gun.
Figure 16:
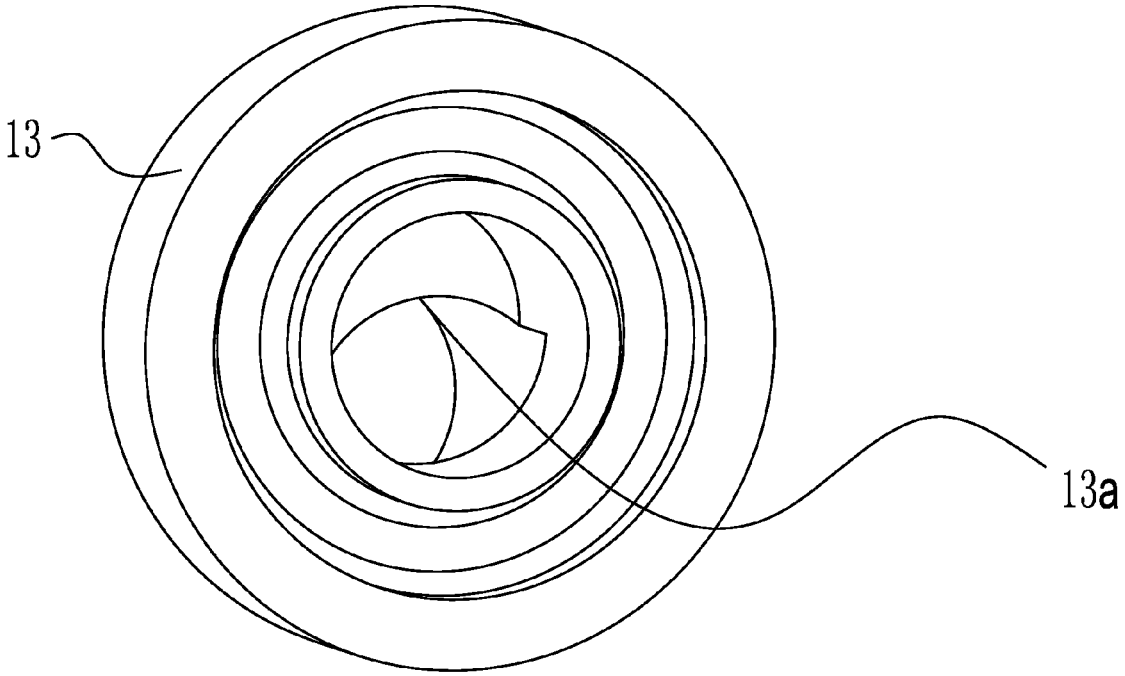
FIG. 16 is a stereogram of a decentered interface comprising an interface deviated from front and rear interfaces.
Figure 17:
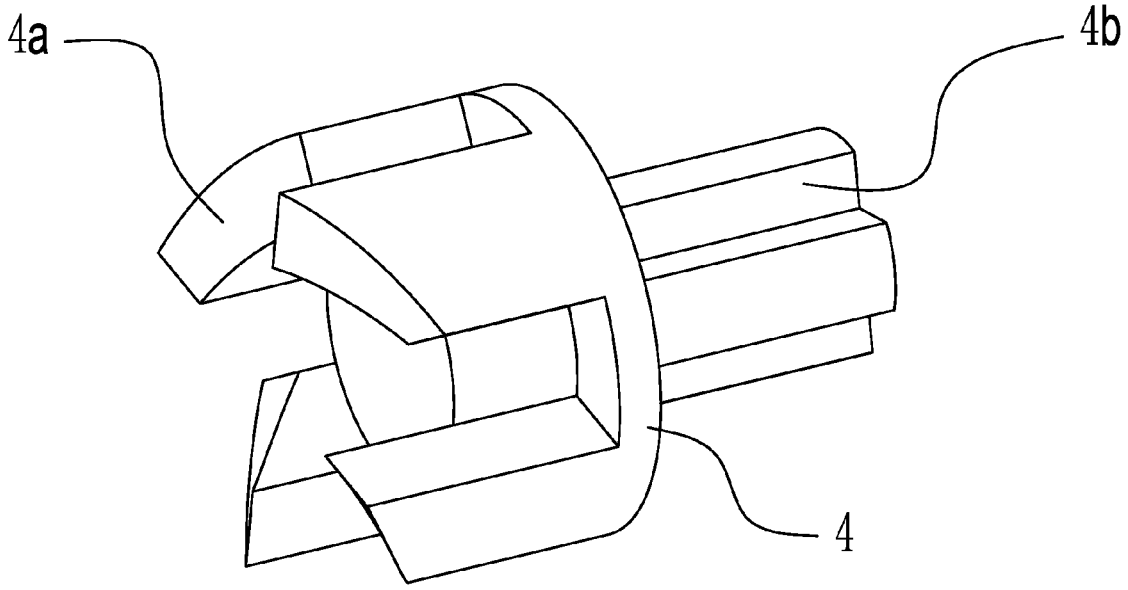
FIG. 17 is a first stereogram of a rotating piece comprising a unilaterally oblique plane of a water spray gun.
Figure 18:
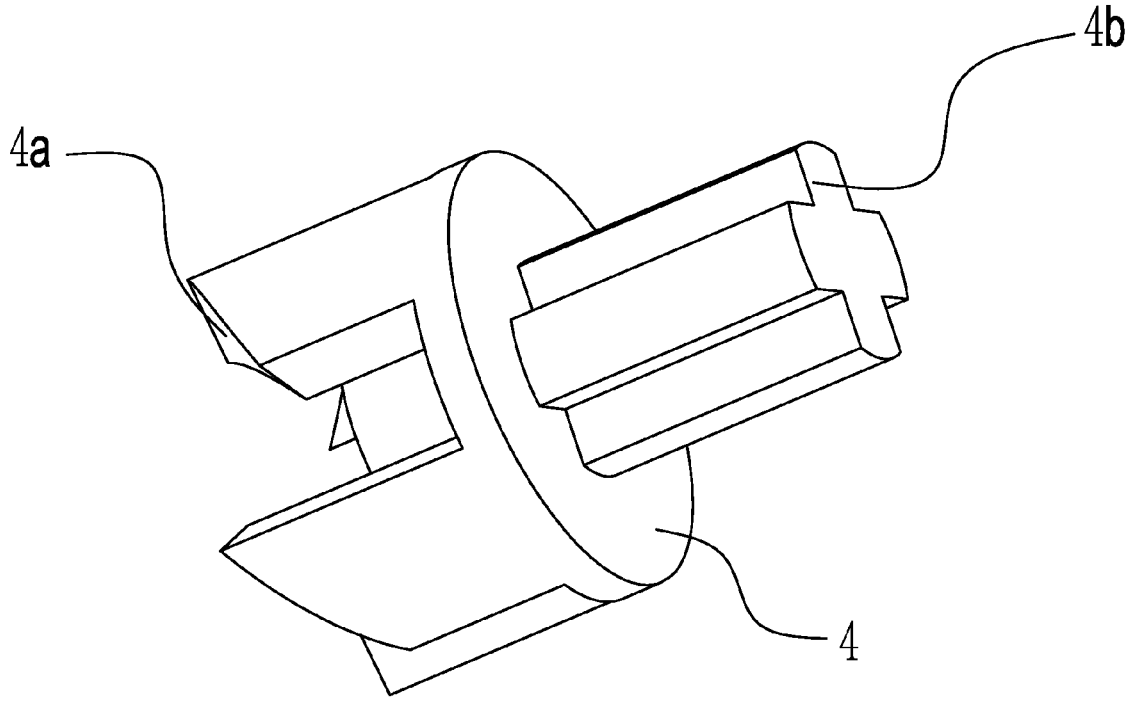
FIG. 18 is a second stereogram of a rotating piece comprising a unilaterally oblique plane of a water spray gun.
Figure 19:
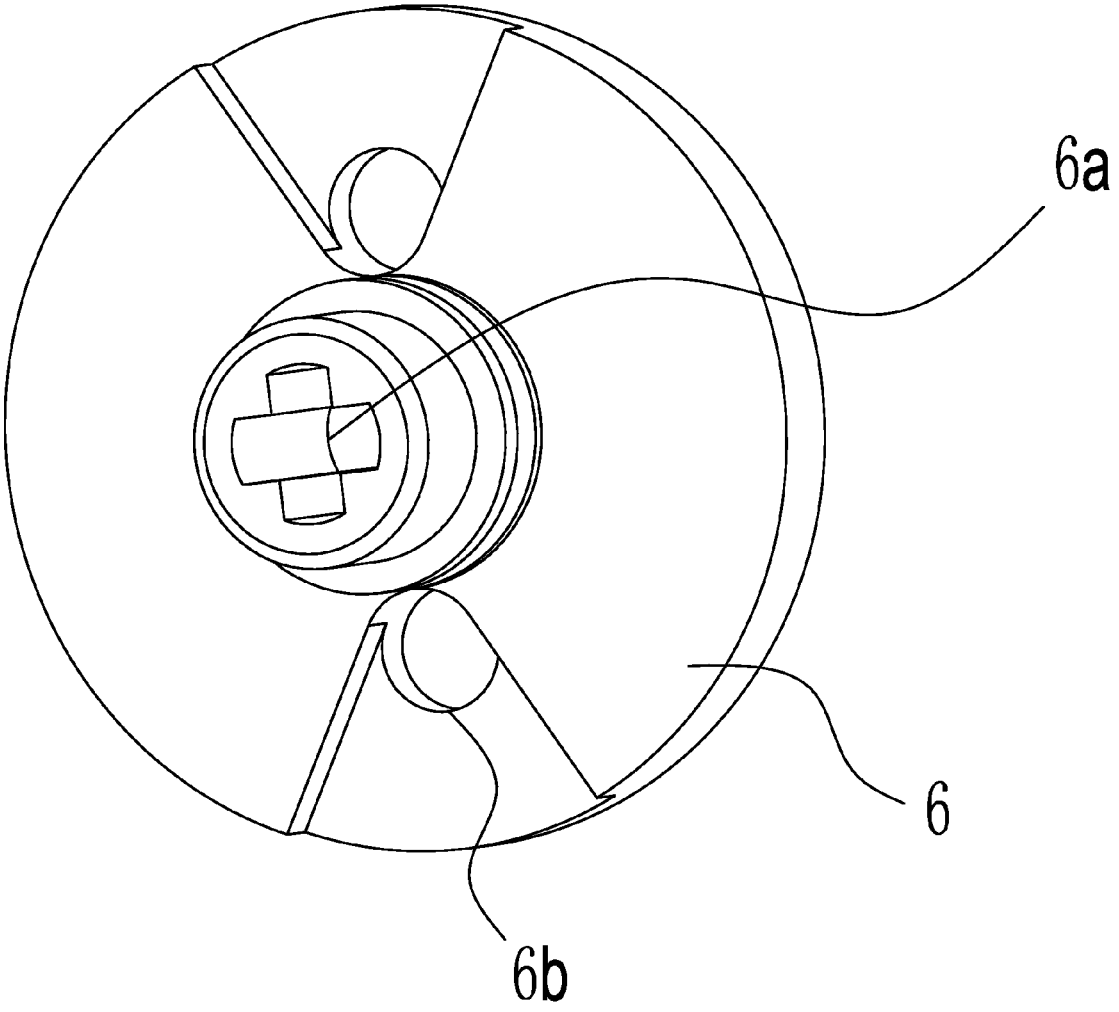
FIG. 19 is a first stereogram of a switch rotating core of a water spray gun.
Figure 20:
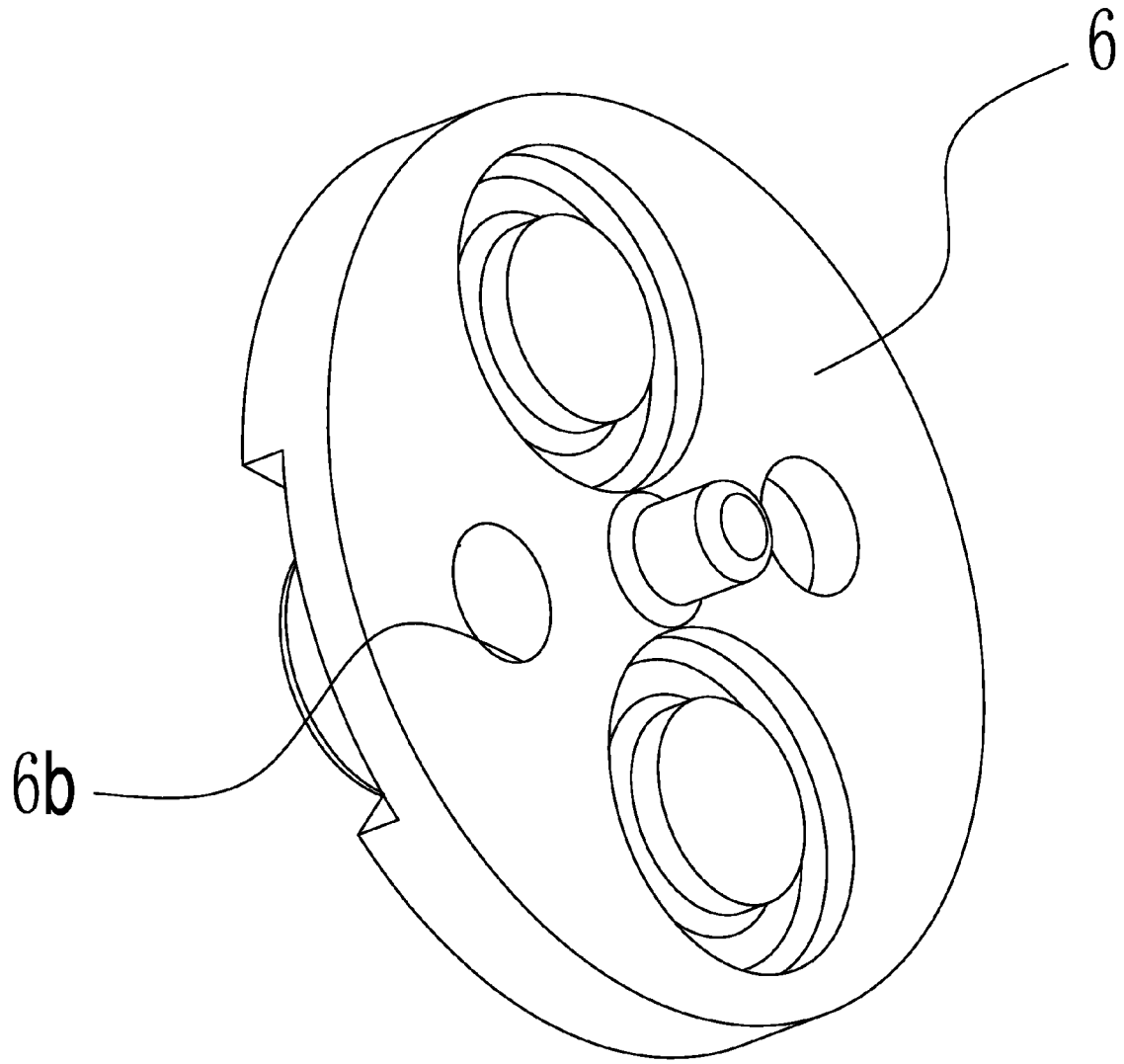
FIG. 20 is a second stereogram of a switch rotating core of a water spray gun.
Figure 21:
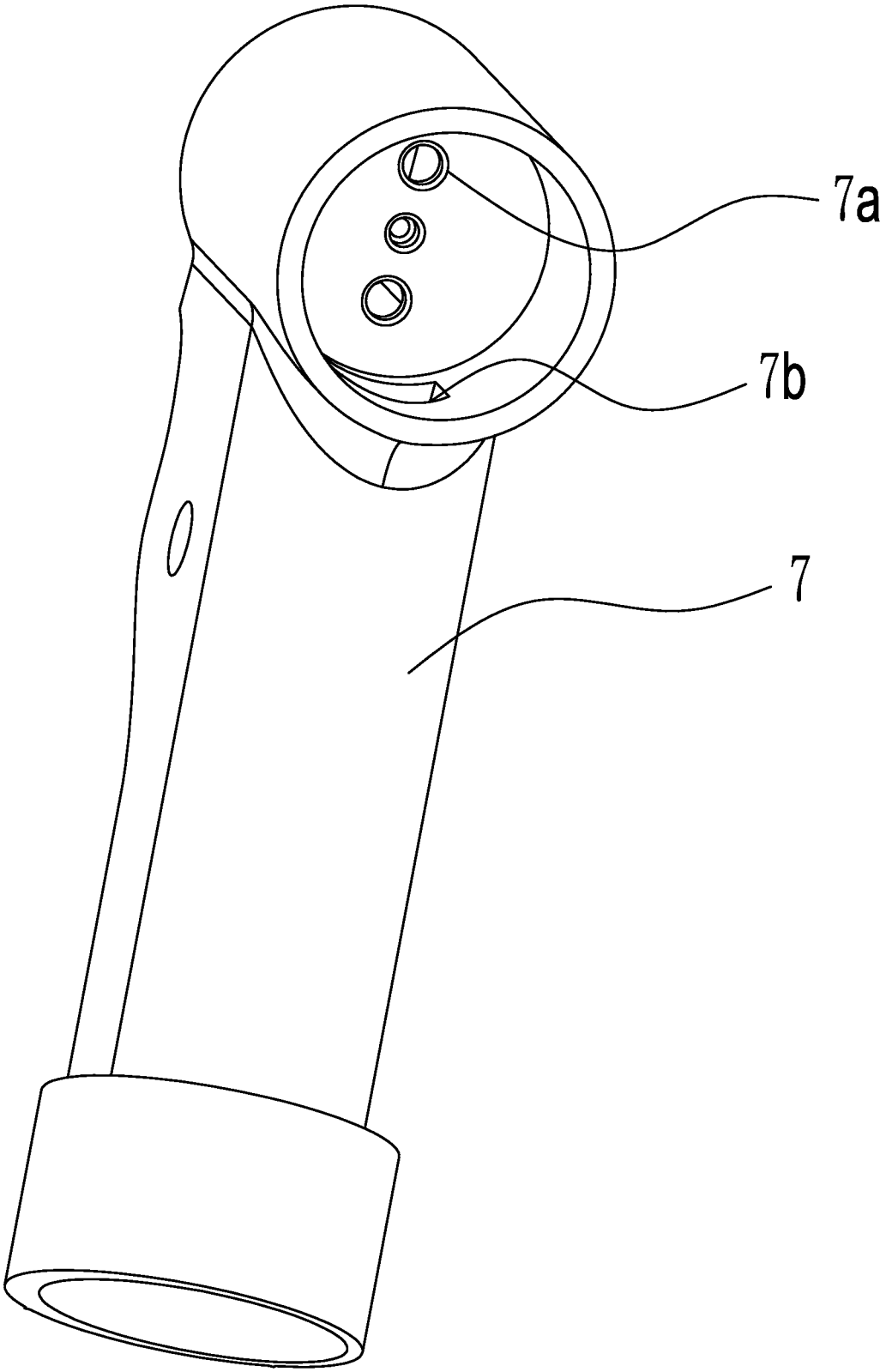
FIG. 21 is a stereogram of a gun body of a water spray gun.
Figure 22:
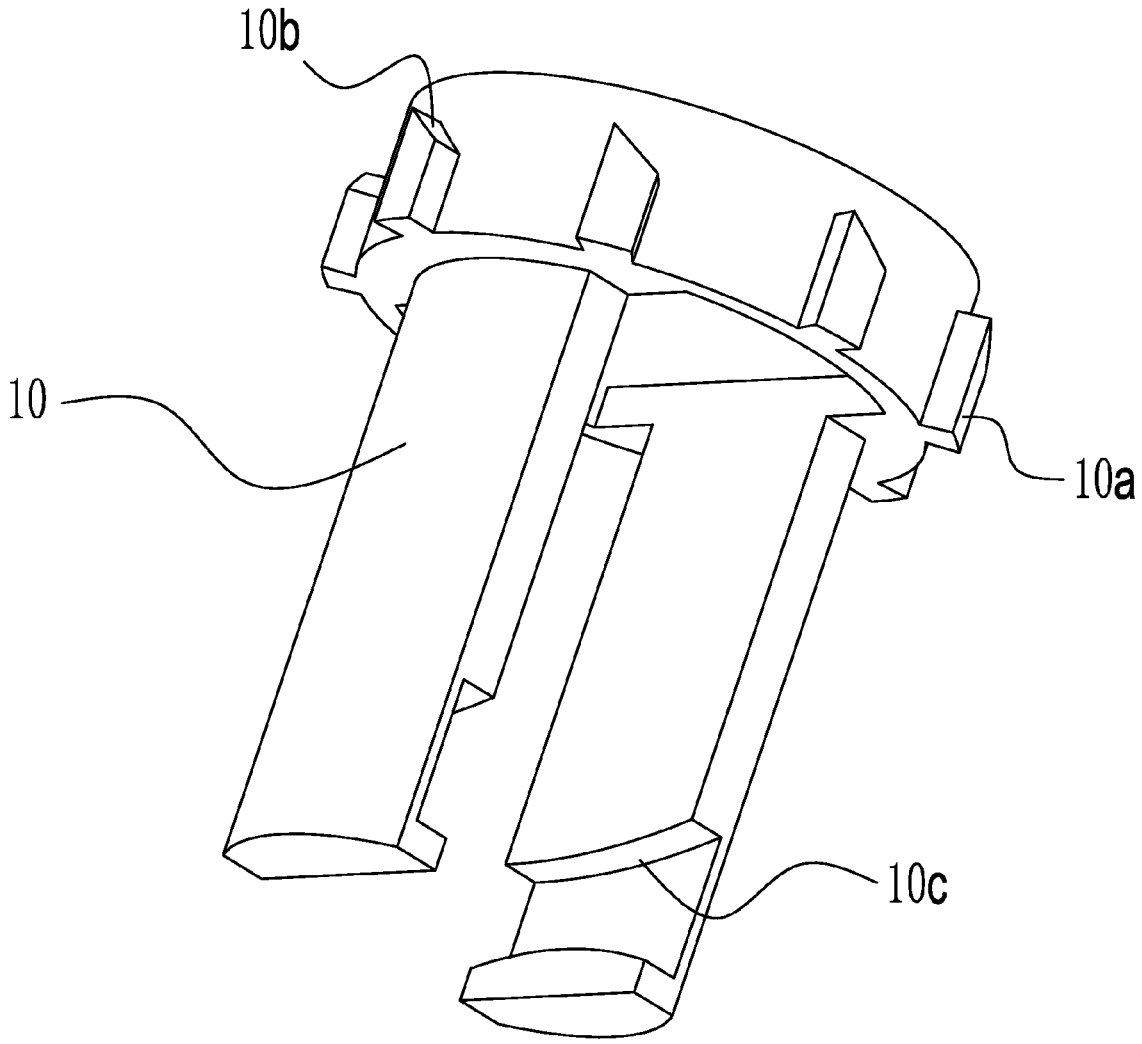
FIG. 22 is a first stereogram of a wedge push rod of a water spray gun.
Figure 23:
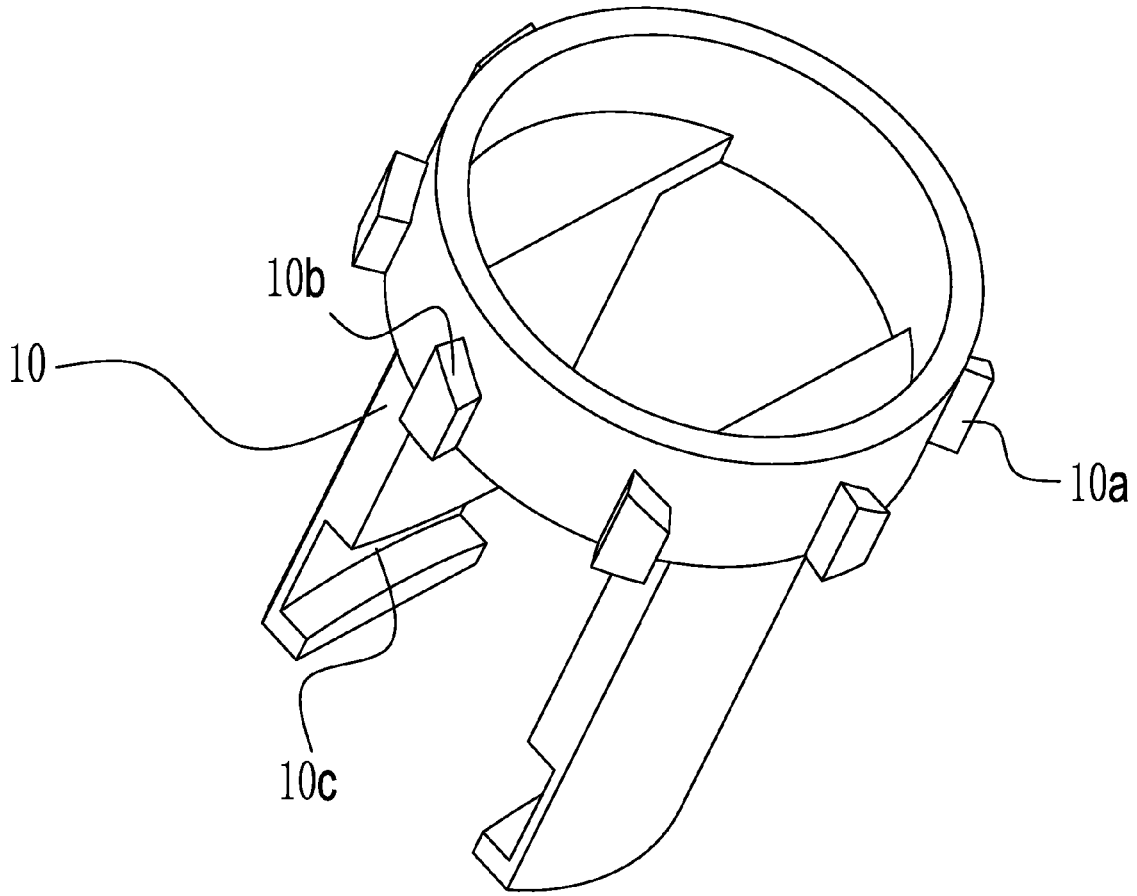
FIG. 23 is a second stereogram of a wedge push rod of a water spray gun.
Figure 24:
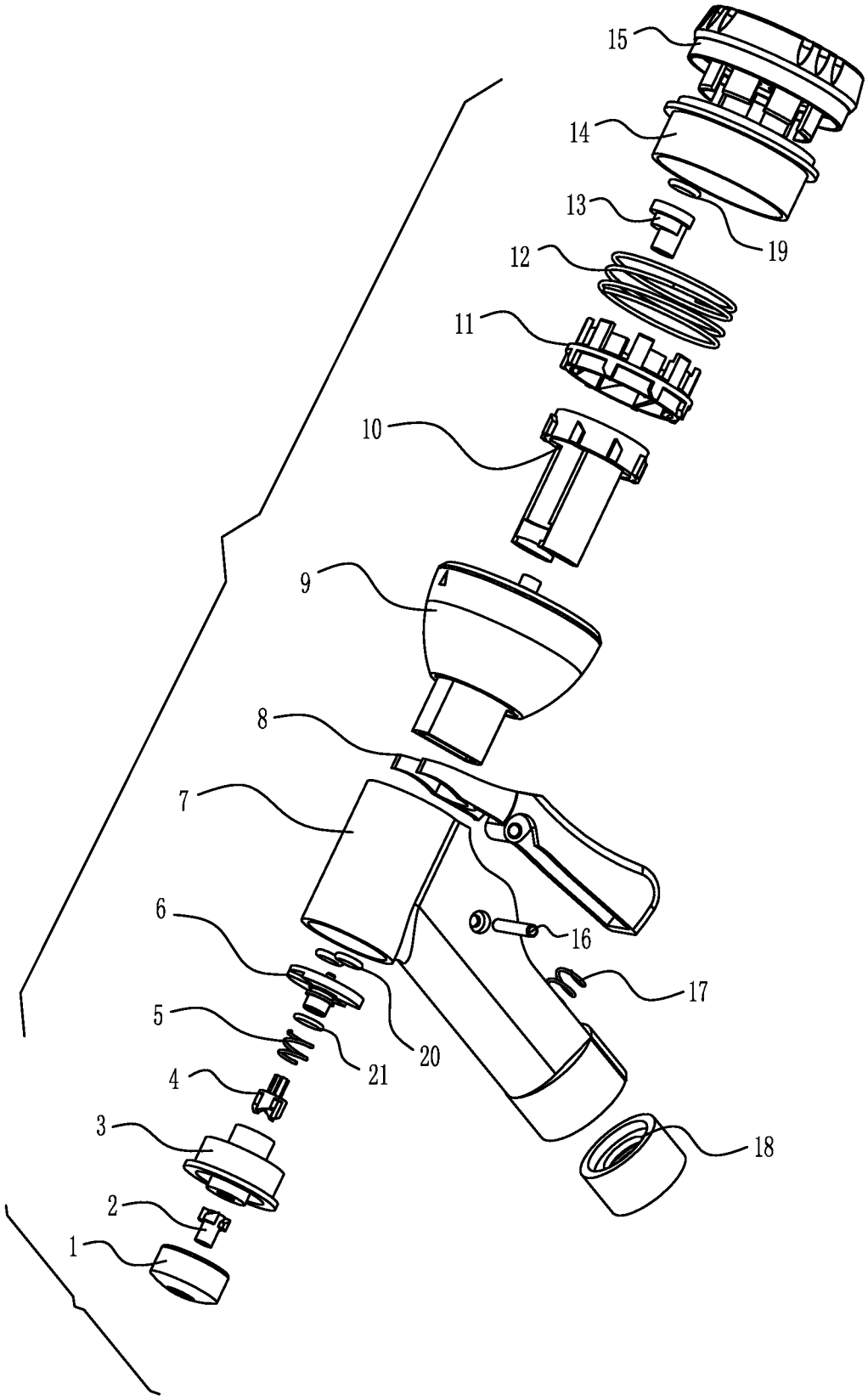
FIG. 24 is an exploded view of components of a water spray gun.
Figure 25:
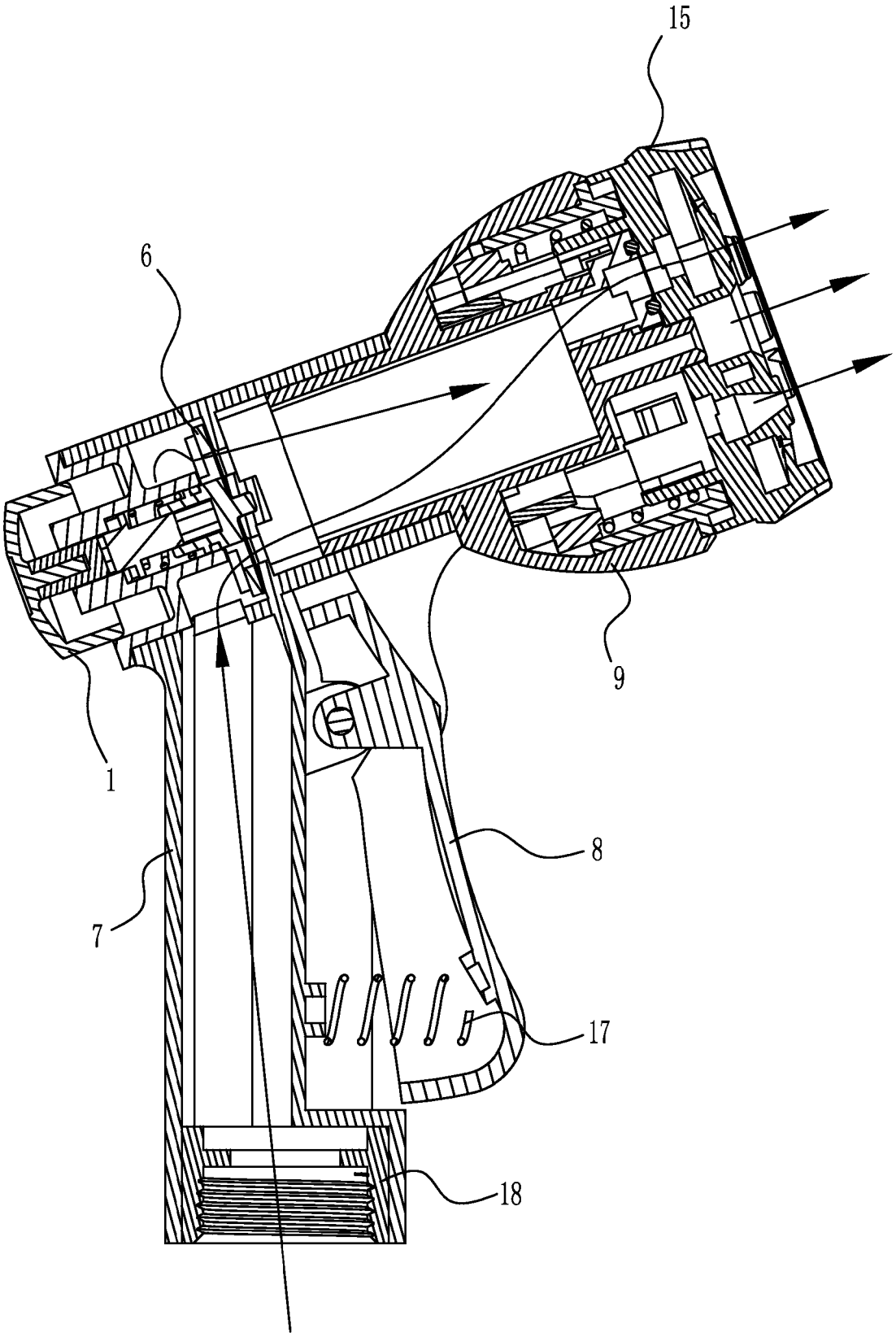
FIG. 25 is a cross sectional view of a water spray gun with arrows indicating a direction of water flow.

In the drawings, the following numbers are used: 1. Button; 2. Pressing piece comprising unilaterally oblique plane; 2*a*. Positive wedge plane; 3. Rear plate comprising inner guide rail; 3*a*. Inner guide rail; 4. Rotating piece comprising unilaterally oblique plane; 4*a*. Unilaterally oblique plane; 4*b*. Cross convex; 5. First spring; 6. Switch rotating core; 6*a*. Cross concave; 6*b*. Water through holes provided with a fan-shaped groove; 7. Gun body; 7*a*. Double water hole; 7*b*. Water passage; 8. Trigger; 8*a*. Double-prong fork; 8*c*. Pin through hole; 9. Housing of gun head; 10. Wedge push rod; 10*a*. Positive wedge block; 10*b*. Positive wedge; 10*c*. Recess; 11. Wedge rotating piece for water diversion; 11*a*. Negative wedge; 11*b*. Negative wedge block; 12. Second spring; 13. Decentered interface; 13*a*. Interface deviated from front and rear interfaces; 14. Water spray plate; 15. Water spray cap; 16. Pin; 17. Third spring; 18. Water inlet; 19. Sealing ring; 20. Double sealing ring; and 21. Front sealing ring.

DETAILED DESCRIPTION OF THE EMBODIMENTS

For further illustrating the invention, experiments detailing a water spray gun are described hereinbelow combined with the drawings.

To use the water spray gun, the user is required to connect a water inlet of the water spray gun to a water source via a hose. The water spray gun is operable by one hand. The water spray gun is provided with a device for switching the water spray pattern therein, and the switch among different water spray patterns is operated by one hand, thereby being superior to conventional water spray guns with double-handed operation.

The water spray gun of the invention comprises: a gun body 7, the gun body 7 comprising: a water passage 7*b* and double water hole 7*a* disposed therein; a valve switch, the valve switch comprising: a button 1, a pressing piece 2 comprising a unilaterally oblique plane, a rear plate 3 comprising an inner guide rail, a rotating piece 4 comprising a unilaterally oblique plane, a first spring 5, a front sealing ring 21, a switch rotating core 6, and a double sealing ring 20 being successively mounted at an upper rear part of the gun body; and a device for switching a spray pattern, the device comprising a water spray cap 15, a water spray plate 14, a decentered interface 13, a second spring 12, a wedge rotating piece 11 for water diversion comprising a plurality of negative wedge blocks 11*b* each comprising a negative wedge 11*a*, a wedge push rod 10 comprising a plurality of positive wedge blocks 10*a* each comprising a positive wedge 10*b*, a housing 9 of a gun head, and a trigger 8 being successively mounted on an upper part of the gun body. The button 1 is movably disposed on an upper rear part of the gun body for controlling the valve switch to close or open the water passage. The trigger 8 is movably disposed at a middle part of the gun body for controlling the device for switching the spray pattern via a pin 16. A water flowing state and a water stopping sate of the switch valve are switched by pressing and releasing the button 1 for once. When the button is pressed 1, the pressing piece 2 is driven by the inner guide rail of the rear plate 3 to move merely in a pressing direction while the rotating piece 4 is driven by the unilaterally oblique plane of the pressing piece 2 to rotate. The switch rotating core 6 is driven by the rotating piece 4 to close or open the double water hole 7*a* disposed inside the gun body to control the water flow in the water passage 7*b* whereby realizing the switch between the water flowing state and the water stopping state. When a lower part of the trigger is pressed, an upper part of the trigger functions as a lever using the pin as a fulcrum and pushes the wedge push rod 10. The positive wedge 10*b* of each positive wedge block 10*a* disposed on the wedge push rod 10 interacts with the negative wedge 11*a* of each negative wedge block 11*b* disposed at the wedge rotating piece 11 for water diversion so as to drive the wedge rotating piece 11 for water diversion to rotate. The water spray cap 15 is driven by the wedge rotating piece 11 for water diversion to rotate thereby realizing the switch of the water diversion. An integral structure of the water spray gun employs the button 1 to allow the water to pass through, employs the trigger 8 switch the spray pattern, so that the water spray gun is operable by one hand.

The water spray gun of the invention is operable by one hand and is applied in garden and gardening. The design of the trigger of the water spray gun realizes the switch of the water spray pattern, and the button realizes switch of the on/off state of the water flow. Thus, the invention overcomes the difficulties in the conventional water spray guns, for example, the double-handed operation and inconvenience in switching the water spray pattern in a nonstop state of the water spray gun. Besides, the product of the invention decreases the possibility of misoperation by the user. The water passage is disposed inside the gun body 7. The button is disposed on the upper rear part of the gun body 7 for control the switch valve to close or open the water passage. The trigger 8 is disposed on the middle part of the gun body 7 via the pin 16 for controlling the device for switching the water spray pattern. The whole structure of the invention employs the button to control the on/off state of the water flow and the trigger to switch the water spray pattern. The positive wedge blocks 10*a* are uniformly arranged on the periphery of the circular disc of the main body of the wedge push rod 10 along the axis thereof, the wedge push rod 10 is able to cooperate with the wedge rotating piece for water diversion and drive the wedge rotating piece to rotate, thereby switching the water spray pattern. The oblique plane of the positive wedge block is the equiangular spiral surface featuring in equivalent pressure angles or the logarithmic spiral surface, so that the positive wedge is capable of stably cooperating with the negative wedge, and the switch of the water spray pattern is realized. The operation of the water spray gun can be conducted by one hand, thereby being superior to those require double-handed operation. The performance and the working condition of the product of the invention are highly improved.

The invention claimed is:

1. A water spray gun, comprising:

a) a gun body, the gun body comprising: a water passage and double water hole disposed therein;

b) a valve switch, the valve switch comprising: a button, a pressing piece comprising a unilaterally oblique plane, a rear plate comprising an inner guide rail, a rotating piece comprising a unilaterally oblique plane, a first spring, a front sealing ring, a switch rotating core, and a double sealing ring, all of which being successively mounted at an upper rear part of the gun body; and c) a device for switching a spray pattern, the device comprising a water spray cap, a water spray plate, a decentered interface, a second spring, a wedge rotating piece for water diversion comprising a plurality of negative wedge blocks each comprising a negative wedge, a wedge push rod comprising a plurality of positive wedge blocks each comprising a positive wedge, a housing of a gun head, and a trigger, all of which being successively mounted on an upper part of the gun body;

wherein the button is movably disposed on an upper rear part of the gun body for controlling the valve switch to close or open the water passage;

the trigger is movably disposed at a middle part of the gun body for controlling the device for switching the spray pattern via a pin;

a water flowing state and a water stopping sate of the switch valve are switched by pressing and releasing the button for once;

when the button is pressed, the pressing piece is driven by the inner guide rail of the rear plate to move merely in a pressing direction while the rotating piece is driven by the unilaterally oblique plane of the pressing piece to rotate; and the switch rotating core is driven by the rotating piece to close or open the double water hole disposed inside the gun body to control the water flow in the water passage whereby realizing the switch between the water flowing state and the water stopping state; and when a lower part of the trigger is pressed, an upper part of the trigger functions as a lever using the pin as a fulcrum and pushes the wedge push rod; the positive wedge of each positive wedge block disposed on the wedge push rod interacts with the negative wedge of each negative wedge block disposed at the wedge rotating piece for water diversion so as to drive the wedge rotating piece for water diversion to rotate; the water spray cap is driven by the wedge rotating piece for water diversion to rotate thereby realizing the switch of the water diversion.

2. The water spray gun of claim 1, wherein the positive wedge blocks are uniformly arranged on a periphery of a circular disc of a main body of the wedge push rod along an axis thereof;

each positive wedge block is provided with an oblique plane to form the positive wedge; and the positive wedge is capable of cooperating with the negative wedge of each of the negative wedge blocks of the wedge rotating piece for water diversion to drive the wedge rotating piece for water diversion to rotate thereby switching the spray pattern.

3. The water spray gun of claim 1, wherein the positive wedge blocks are uniformly arranged on a periphery of a circular disc of a main body of the wedge push rod along an axis thereof;

each positive wedge block is provided with an oblique plane being an equiangular spiral surface featuring in equivalent pressure angles or a logarithmic spiral surface; and the positive wedge is capable of cooperating with the negative wedge of each of the negative wedge blocks of the wedge rotating piece for water diversion to drive the wedge rotating piece for water diversion to rotate thereby switching the spray pattern.

4. The water spray gun of claim 1, wherein two push rods are symmetrically extended from a circular disc of a main body of the wedge push rod along an axis thereof; and on each push rod is disposed a recess, and two sides of the recess are in the shape of an arc for allowing the trigger to pluck the recess.

5. The water spray gun of claim 1, wherein a pin through hole is disposed at a middle part of the trigger for allowing the pin to pass through and be movably mounted on the gun body;

an upper part of the trigger is provided with a double-prong fork;

the wedge push rod is provided with two push rods, each push rod comprises a recess having two sides in the shape of an arc; and the double-prong fork is capable of plucking the recesses of the push rods on the wedge push rod.

6. The water spray gun of claim 1, wherein the rear plate is provided with the inner guide rail formed by a plurality of uniformly arranged splines for allowing lateral sides of positive wedge planes of the pressing piece to move merely in the pressing direction.

7. The water spray gun of claim 1, wherein a plurality of positive wedge planes are uniformly arranged on a column of a main body of the pressing piece along an axis thereof for pushing the unilaterally oblique plane of the rotating piece to allow the rotating piece to rotate; and a cross convex arranged on the rotating piece matches with a cross concave arranged on the switch rotating core for driving the switch rotating core to rotate thereby turning on or off the water flow.

8. The water spray gun of claim 1, wherein a plurality of positive wedge planes are uniformly arranged on a column of a main body of the pressing piece along an axis thereof;

each of the positive wedge planes is an equiangular spiral surface featuring in equivalent pressure angles or a logarithmic spiral surface;

the positive wedge plane of the pressing piece is capable of stably pushing the unilaterally oblique plane of the rotating piece to allow the rotating piece to rotate; and a cross convex arranged on the rotating piece matches with a cross concave arranged on the switch rotating core for driving the switch rotating core to rotate whereby turning on or off the water flow.

9. The water spray gun of claim 1, wherein a cross concave disposed at a middle part of the switch rotating core matches with a cross convex disposed at a middle part of the rotating piece for driving the switch rotating core to rotate whereby turning on or off the water flow; and water through holes provided with fan-shaped grooves are symmetrically arranged on two lateral sides of the center of the switch rotating core for allowing the water to pass through.

* * * * *